US007683280B2

(12) United States Patent
Hsu

(10) Patent No.: US 7,683,280 B2
(45) Date of Patent: Mar. 23, 2010

(54) KEYBOARDS AND KEY STRUCTURES THEREOF

(75) Inventor: Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 851 days.

(21) Appl. No.: 11/476,264

(22) Filed: Jun. 28, 2006

(65) Prior Publication Data

US 2007/0012153 A1 Jan. 18, 2007

(30) Foreign Application Priority Data

Jul. 1, 2005 (TW) ..... 94122350 A

(51) Int. Cl.
*H01H 13/70* (2006.01)

(52) U.S. Cl. ..... 200/344

(58) Field of Classification Search ..... 200/517, 200/344, 345; 400/490–496
See application file for complete search history.

(56) References Cited

U.S. PATENT DOCUMENTS 5,504,283 A * 4/1996 Kako et al. ..... 200/5 A
5,767,468 A * 6/1998 Tsai ..... 200/344
5,833,050 A * 11/1998 Takagi et al. ..... 200/344
5,842,798 A * 12/1998 Su ..... 400/491.2
5,947,616 A * 9/1999 Liang ..... 400/491.2
6,057,522 A * 5/2000 Chao ..... 200/344
6,172,868 B1 * 1/2001 Oura ..... 361/679.2
6,257,782 B1 * 7/2001 Maruyama et al. ..... 400/495.1
6,376,789 B2 * 4/2002 Maruyama et al. ..... 200/344
6,382,856 B2 * 5/2002 Hu ..... 400/495
7,138,587 B2 * 11/2006 Nishino et al. ..... 200/5 A
7,238,908 B1 * 7/2007 Chen ..... 200/344

* cited by examiner

*Primary Examiner*—Michael A Friedhofer
(74) *Attorney, Agent, or Firm*—Quintero Law Office

(57) ABSTRACT

Key structures are provided. A key structure comprises a substrate, a first rod, a second rod, and a key cover. The substrate comprises a first surface, a through hole, and a plurality of contact portions fixed to the first surface. Each of the contact portions has a contact surface partially covering the through hole. The first rod comprises a first primary pivot accommodated in the through hole and slidable on one of the contact surfaces, and a first auxiliary pivot slidable on the first surface. The second rod is movably connected to the first rod, comprising a second primary pivot accommodated in the through hole and a second auxiliary pivot abutting the first surface. The key cover is movable with respect to the substrate and connected to the first and second rods.

22 Claims, 10 Drawing Sheets

KEYBOARDS AND KEY STRUCTURES THEREOF

BACKGROUND OF THE INVENTION

1. Field of the Invention

The invention relates in general to keyboards and in particular to curved keyboards with improved structural strength.

2. Description of the Related Art

Referring to FIG. 1, a conventional wave-shaped keyboard primarily comprises a main body M and a plurality of key units 10. Each of the key units 10 includes a first rod 101, a second rod 102 and a key cover 103. The main body M includes a top frame 20, a curved substrate module 300, a support member 40, a circuit board 50, a base plate 60, and a bottom frame 70. The top frame 20, the base plate 60, and the lower frame 70, are joined to hold the keyboard. The curved substrate module 300, support member 40, and circuit board 50 are disposed over the base plate 60 and encompassed by the top and bottom frames 20 and 70.

As shown in FIG. 1, the substrate module 300 has a plurality of holes H and pivot portions P rotatably connected to the first and second rods 101 and 102. A plurality of elastomers 401 project from the support member 40 and pass through the holes H. When the key covers 103 are depressed, the elastomers 401 are deformed downward to activate corresponding switches (not shown) on the circuit board 50.

Generally, the top frame 20 is plastic, and the substrate module 300 is metal. The holes H and pivot portions P can be shaped by mechanical stamping and punching. However, the substrate module 300 may not provide good structural strength for the keyboard due to flexibility of metal. Moreover, unintentional impacts on the protrusive pivot portions P during assembly may cause deformation and damages of the metal substrate module 300.

BRIEF SUMMARY OF THE INVENTION

Key structures are provided. A key structure comprises a substrate, a first rod, a second rod and a key cover. The substrate comprises a first surface, a through hole and a plurality of contact portions fixed to the first surface. Each of the contact portions has a contact surface partially covering the through hole. The first rod comprises a first primary pivot accommodated in the through hole and slidable on one of the contact surfaces, and a first auxiliary pivot slidable on the first surface. The second rod is movably connected to the first rod, comprising a second primary pivot accommodated in the through hole and a second auxiliary pivot abutting the first surface. The key cover is movable with respect to the substrate and connected to the first and second rods.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
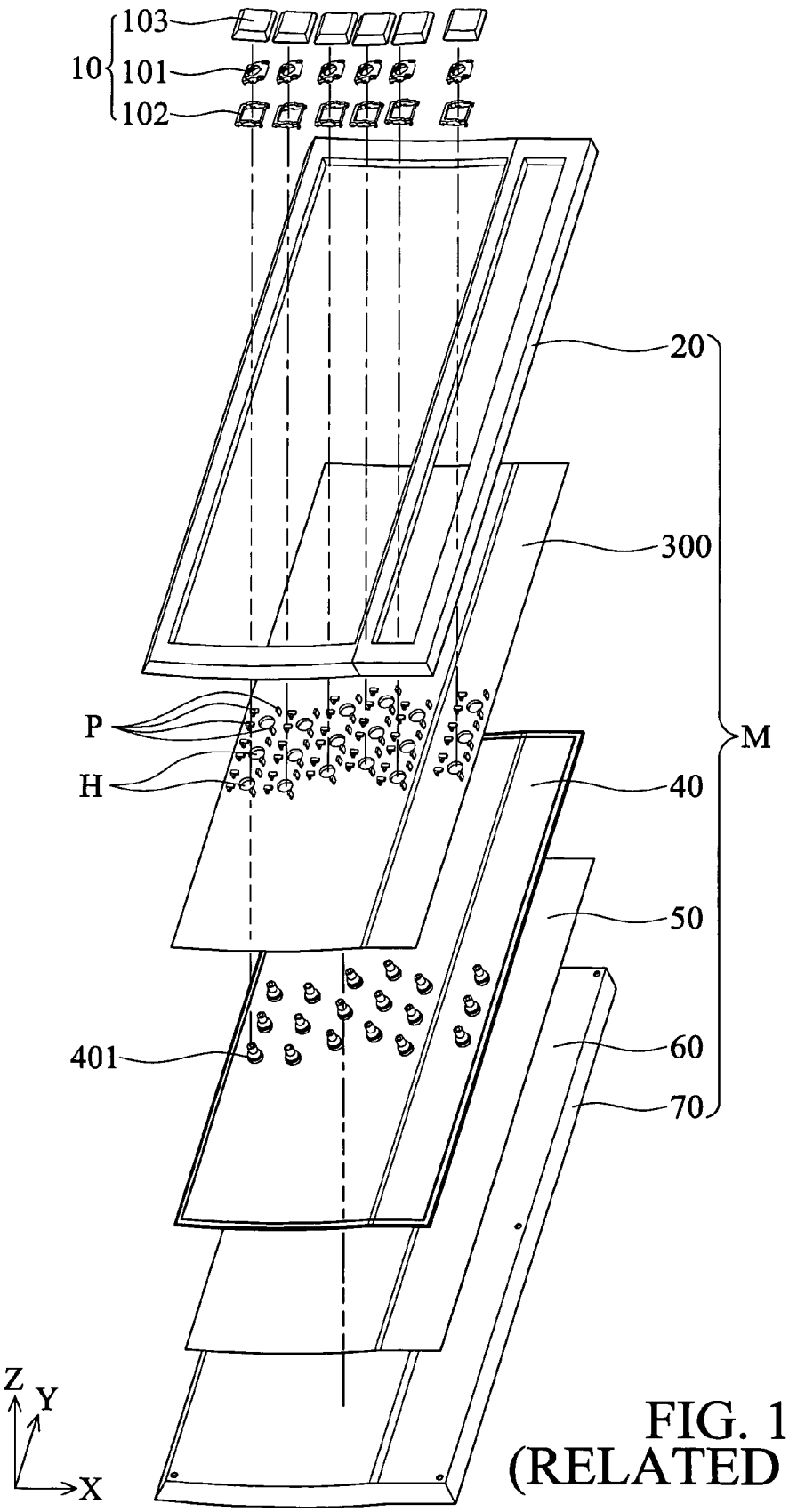
FIG. 1 (RELATED ART)
FIG. 1 is an exploded diagram of a conventional keyboard.
Figure 2A:
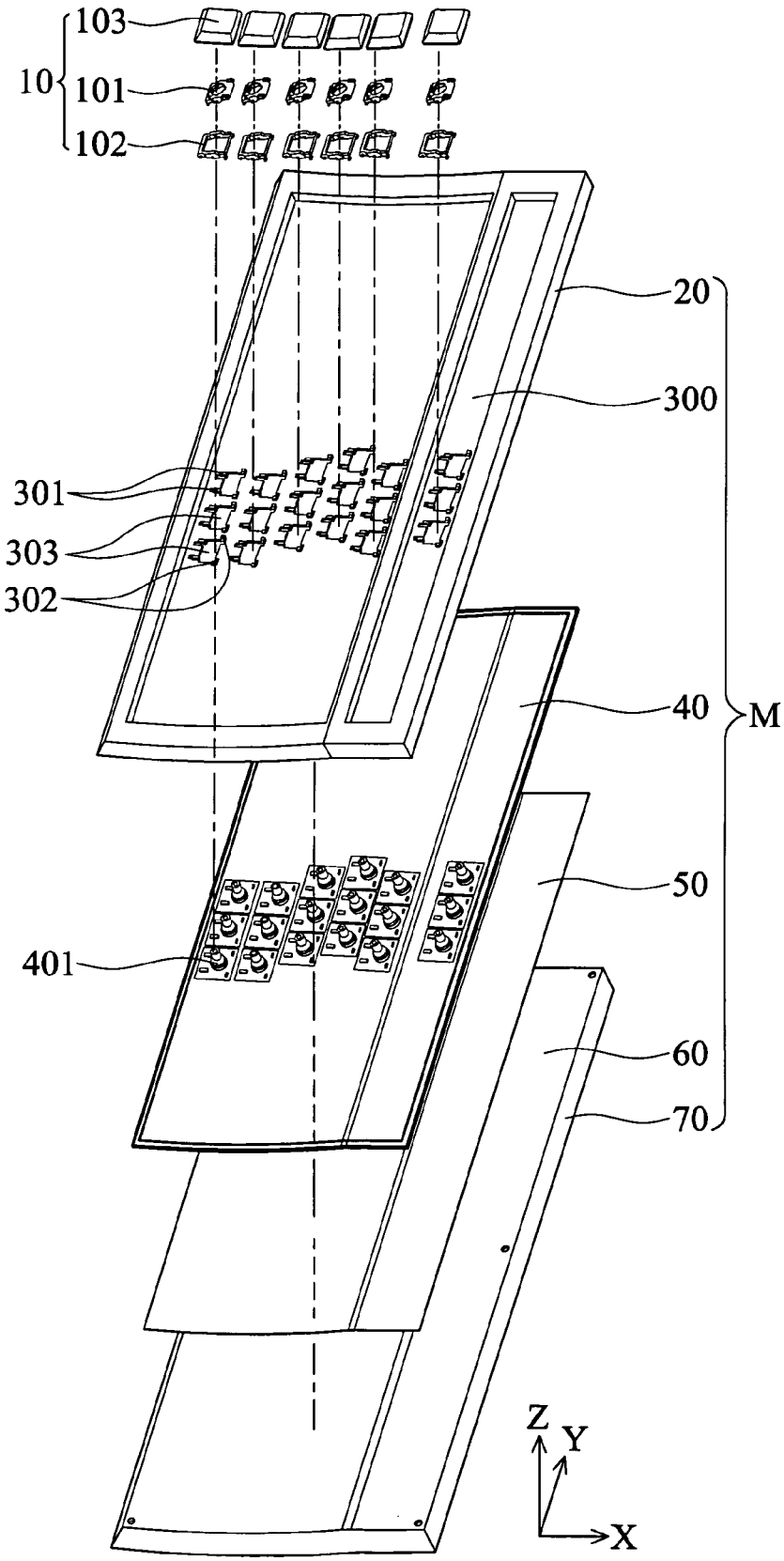
FIG. 2A is an exploded diagram of an embodiment of a keyboard.

Referring to FIG. 2A, an embodiment of a wave-shaped keyboard primarily comprises a main body M and a plurality of key units 10. The main body M includes a top frame 20, a curved substrate module 300, a support member 40, a circuit board 50, a base plate 60 and a bottom frame 70. The curved substrate module 300, support member 40 and circuit board 50 are disposed over the base plate 60 and encompassed by the top frame and bottom frames 20 and 70. In some embodiments, the base plate 60 and the bottom frame 70 are monolithically formed, improving structural strength and reducing production cost of the keyboard.

Figure 4:
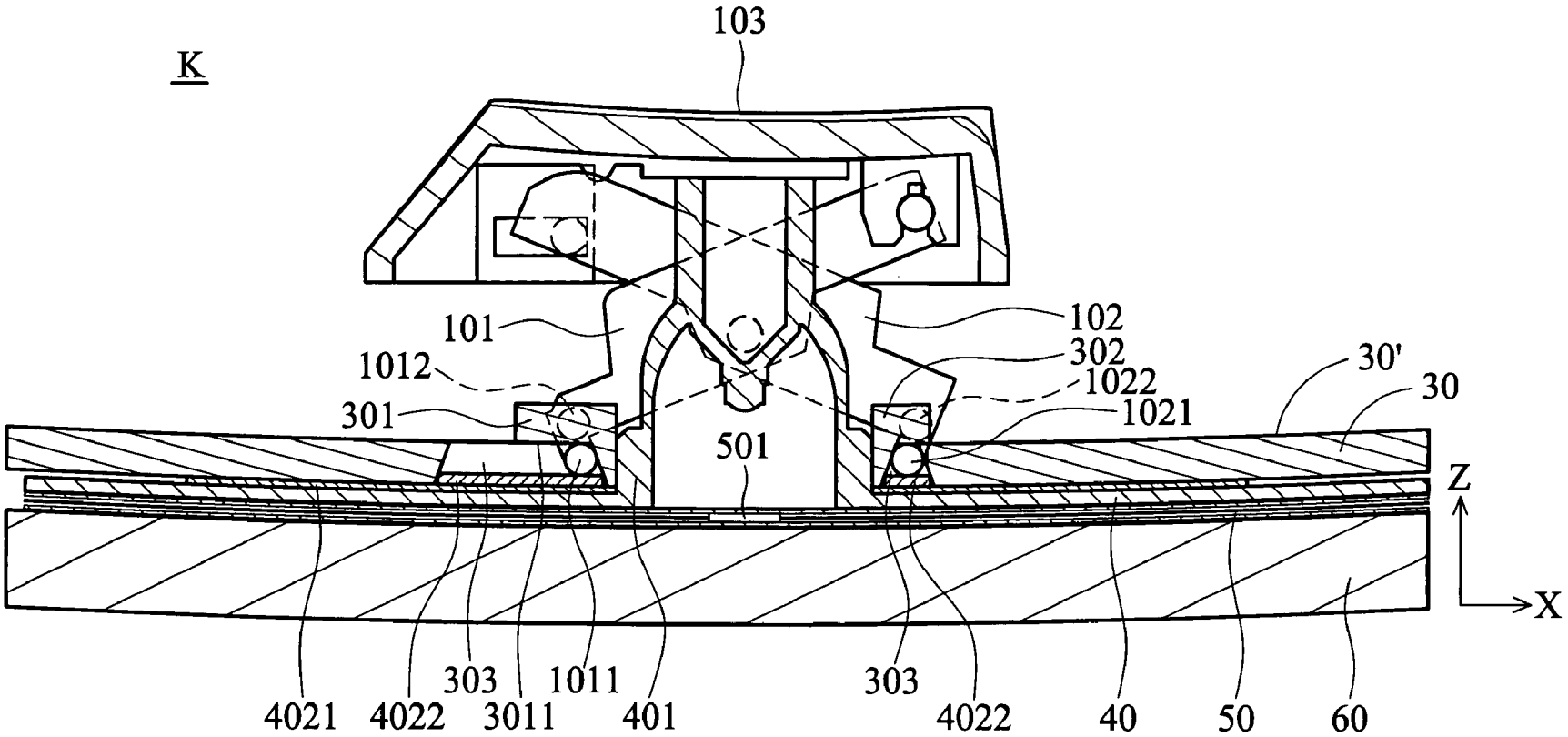
FIGS. 4 and 5 are sectional views of the key structure in FIG. 2B.

Each of the key units 10 includes a first rod 101, a second rod 102, and a key cover 103. The first and second rods 101 and 102 form a scissors-type support mechanism (as shown in FIG. 4) pivotally connecting the key cover 103 and the substrate module 300. In some embodiments, the top frame 20 and the substrate module 300 are monolithically formed of plastic, improving structural strength and reducing production cost of the keyboard.

Figure 2B:
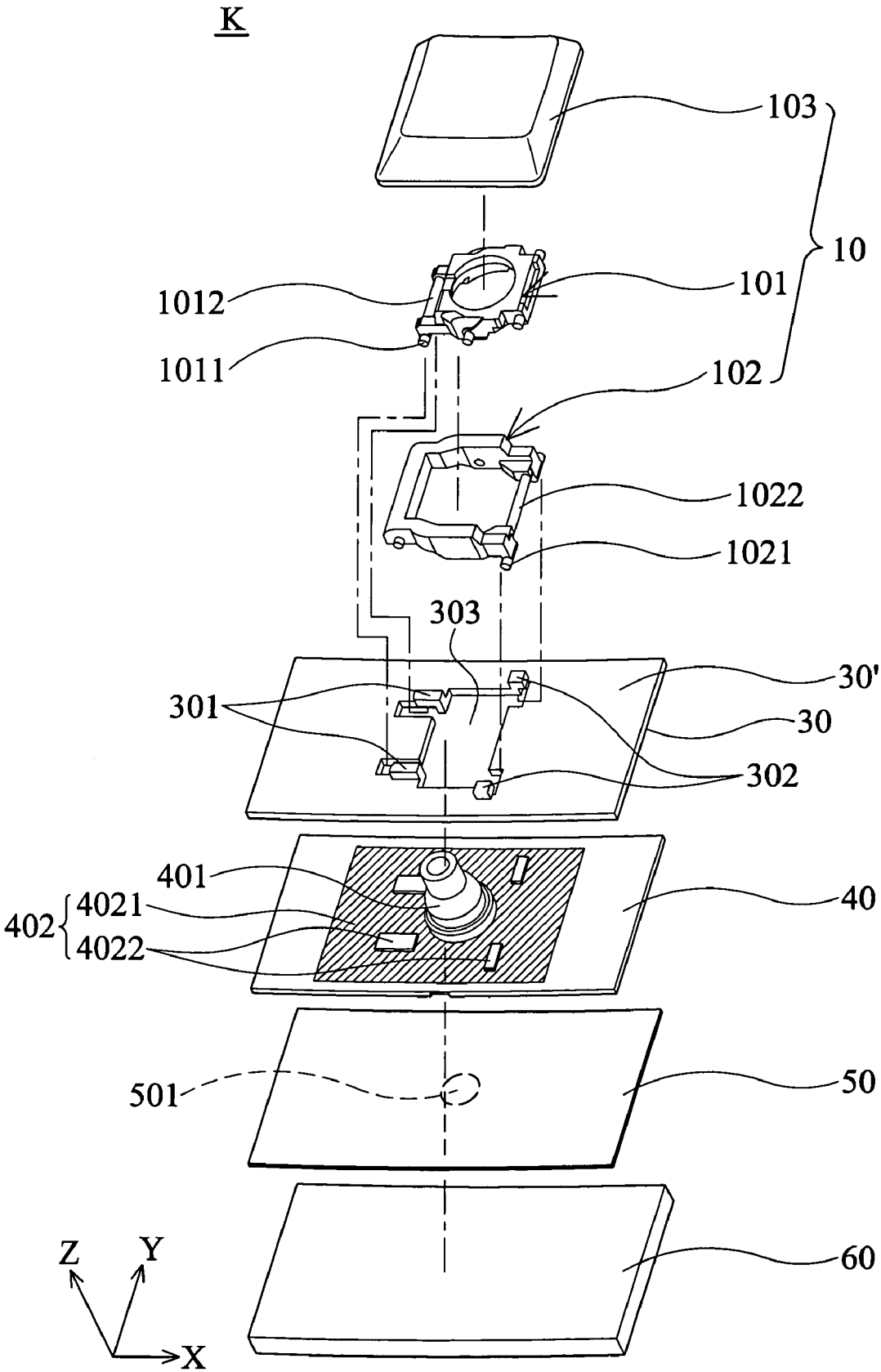
FIG. 2B is an exploded diagram of a key structure of the keyboard in FIG. 2A.

The keyboard of FIG. 2A can be divided into a plurality of key structures K as shown in FIG. 2B. Each of the key structures K in FIG. 2B comprises a key unit 10, a substrate 30, a part of the support member 40, circuit board 50 and base plate 60. The substrates 30 of the key structures K are monolithically formed of plastic material in one piece as the substrate module 300 in FIG. 2A.

Figure 3A:
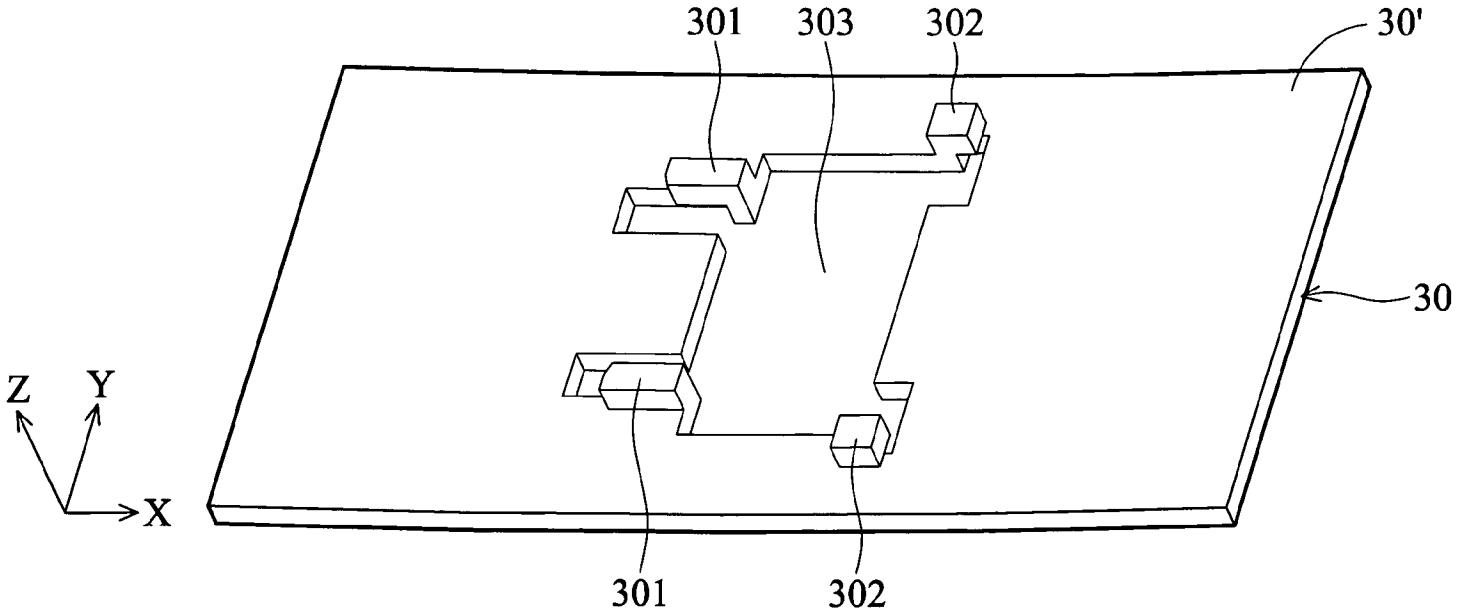
FIG. 3A is a perspective diagram of the substrate in FIG. 2B.
Figure 3B:
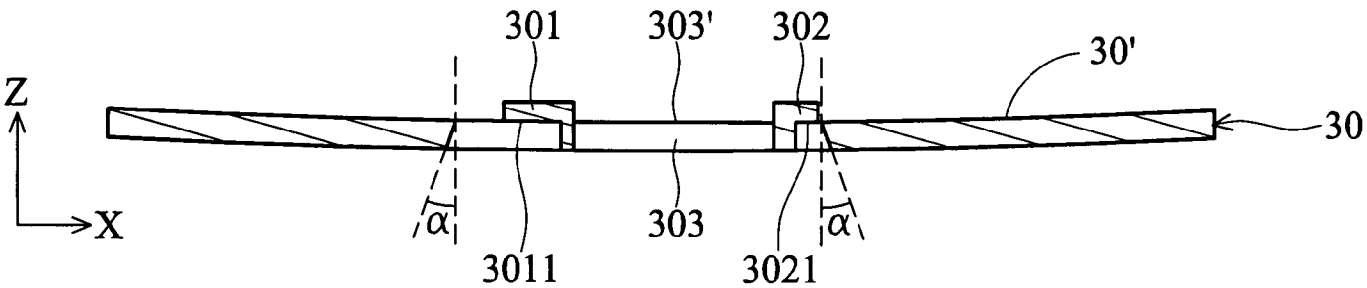
FIG. 3B is a sectional view of the substrate in FIG. 3A.

Referring to FIGS. 3A and 3B, the substrate 30 comprises a first surface 30', a through hole 303 and a plurality of contact portions 301 and 302 projecting from the first surface 30', wherein the contact portions 301 and 302 are monolithically formed with the substrate 30. As shown in FIG. 3B, the contact portions 301 and 302 comprise contact surfaces 3011 and 3021, partially covering the through hole 303. Moreover, an inner wall of the through hole 303 is sloped at an angle $\alpha$ with respect to a mold releasing direction (along Z axis) of the substrate 30 or the substrate module 300, preventing mold sticking and jamming.

In FIGS. 3A and 3B, the first surface 30' is curved, and a contour of the through hole 303 on the first surface 30' defines an opening 303'. As shown in FIG. 3B, the contact surfaces 3011 and 3021 of the contact portions 301 and 302 are substantially at the same level as the opening 303'. In some embodiments, the contact surfaces 3011 and 3021 may be lower than the opening 303' or the first surface 30', reducing dimensions in Z direction and facilitating miniaturization.

Referring to FIGS. 2B and 4, the first rod 101 comprises a first primary pivot 1011 and a first auxiliary pivot 1012. The second rod 201 comprises a second primary pivot 2011 and a second auxiliary pivot 2012. As shown in FIG. 4, the first and second primary pivots 1011 and 2011 are accommodated in the through hole 303 and below the first surface 30', respectively abutting the contact surfaces 3011 and 3021 of the contact portions 301 and 302. The first and second auxiliary pivots 1012 and 1022 are against the first surface 30', to retain the first and second primary pivots 1011 and 2011 in the through holes 303. Hence, the substrate 30 and the first and second rods 101 and 102 are pivotally connected by the first and second primary pivots 1011 and 2011 stably held in the through holes 303.

As shown in FIG. 2B, the support member 40 comprises a projecting elastomer 401 and a laminar element 402 abutting the substrate 30. The laminar element 402 comprises a sheet 4021 and a plurality of pads 4022 disposed thereon. In some embodiments, the laminar element 402 is adhered to the bottom of the substrate 30, and the pads 4022 may comprise elastic material.

Referring to FIG. 4, the pads 4022 on the sheet 4021 extend into the through holes 303, corresponding to the contact surfaces 3011 and 3021. The first and second primary pivots 1011 and 2011 are restricted in the through holes 303, between the pads 4022 and the contact surfaces 3011 and 3021. In some embodiments, the first and second primary pivots 1011 and 2011 can also be disposed between the sheet 4021 and the contact surfaces 3011 and 3021 without the pads 4022.

Figure 5:
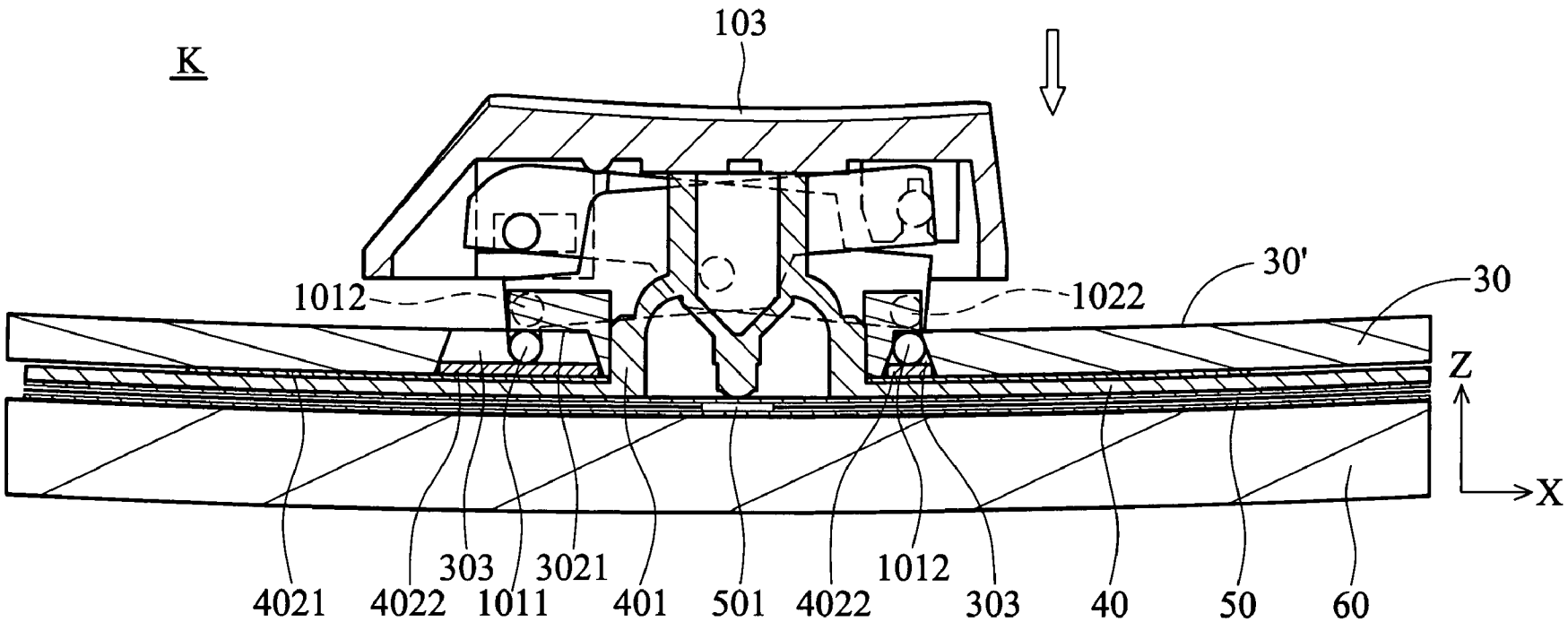

When the key cover 103 is depressed along Z axis from the state shown in FIG. 4 to the state shown in FIG. 5, the first and second rods 101 and 102 rotate with respect to each other, wherein the first primary and auxiliary pivots 1011 and 1012 respectively slide on the contact surface 3011 and the first surface 30' to the left along X axis. Thus, a switch 501 on the circuit board 50 is activated by the elastomer 401 when the key cover 103 is depressed, as shown in FIG. 5. In this embodiment, the second rod 102 and the substrate 30 are only pivotally connected because inner walls of the through hole 303 restrict the second primary pivot 1021 from movement in X direction. However, both of the second primary and auxiliary pivots 1021 and 1022 can also be movable along X axis by sliding on the contact surface 3021 and the first surface 30', respectively.

In some embodiments, the first and second auxiliary pivots 1012 and 1022 can be omitted as the first and second primary pivots 1011 and 1021 are stably hold by the laminar element 402 and the contact portions 301 and 302 without movement in Z direction. Alternatively, the laminar element 402 can be omitted as the first and second primary pivots 1011 and 1021 are stably held by the first and second auxiliary pivots 1012 and 1022 against the first surface 30'.

Figure 6:
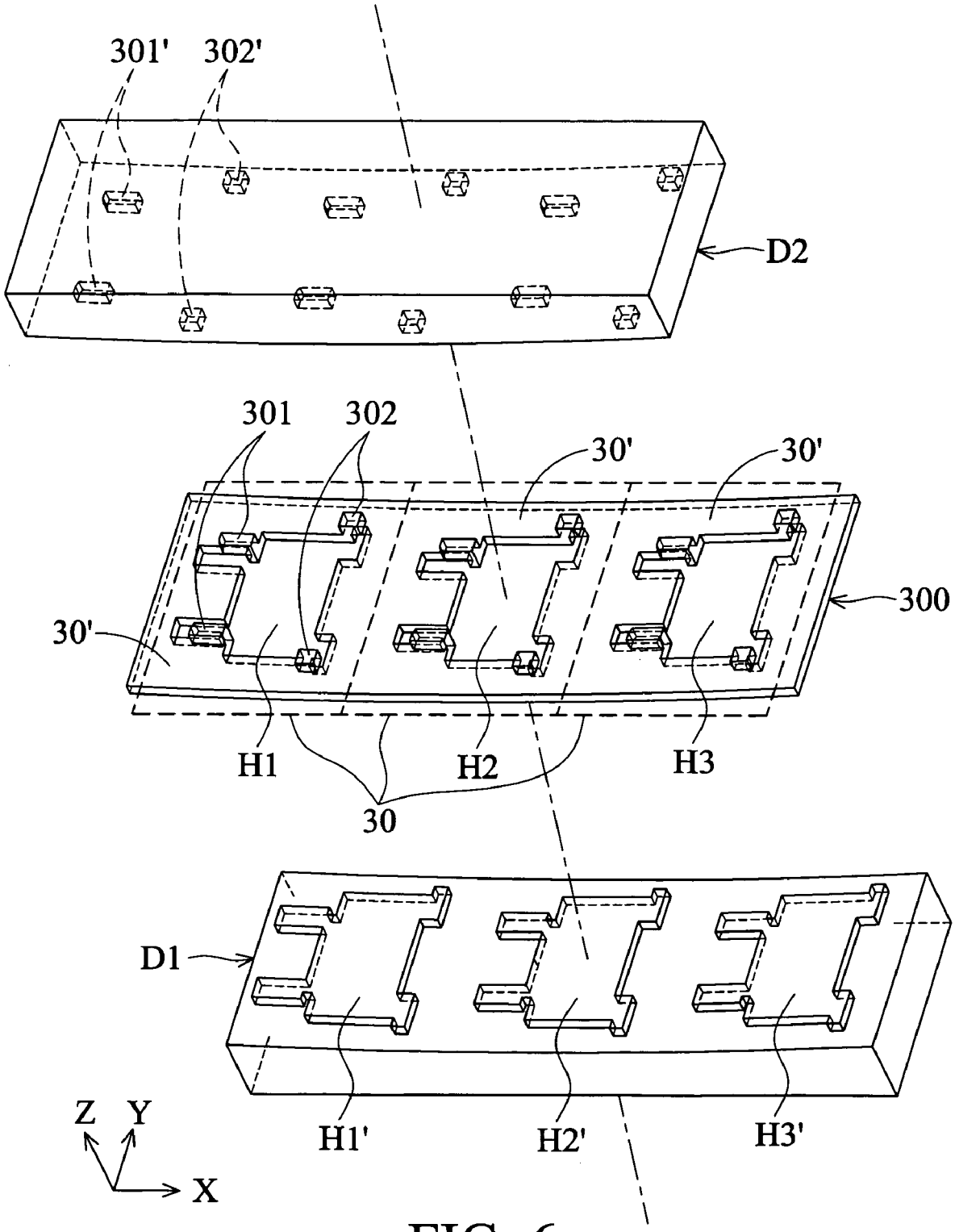
FIG. 6 is a perspective diagram of a substrate module formed by a first mold and a second mold.

Referring to FIG. 6, a first mold D1 and a second mold D2 are provided for manufacturing a substrate module 300 of a keyboard. In FIG. 6, the first mold D1 comprises a plurality of protrusions H1', H2', and H3', and the second mold D2 comprises a plurality of recesses 301' and 302'. The substrate module 300 is formed by filling plastic material between the first and second molds D1 and D2. In the exemplary embodiment, the substrate module 300 includes three substrates 30 with three though holes H1, H2, and H3 respectively formed thereon.

Figure 7A:
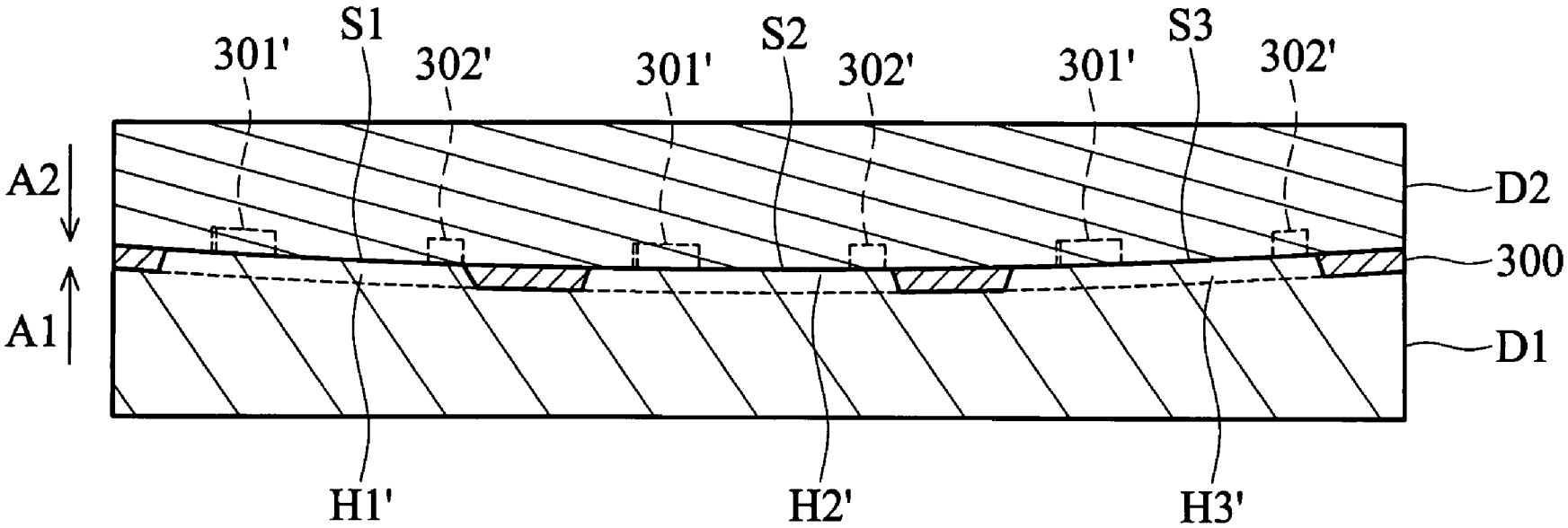
FIG. 7A is a sectional view of the substrate module and the first and second molds when connected.
Figure 7B:
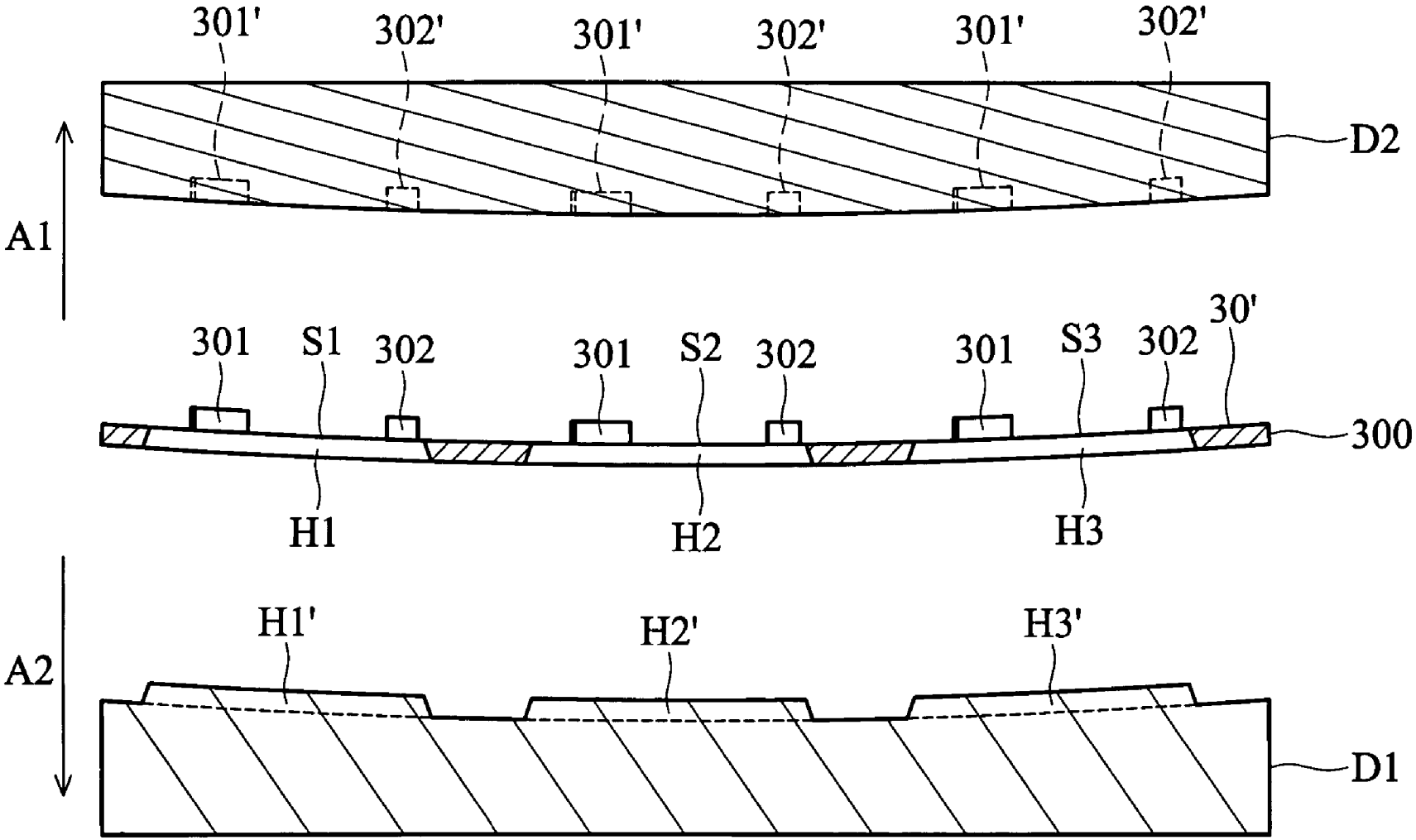
FIG. 7B is a sectional view of the substrate module and the first and second molds when separated.

To produce the substrate module 300, the first and second molds D1 and D2 are connected face to face, as shown in FIG. 7A. Subsequently, the substrate module 300 can be formed by filling plastic material between the first and second molds D1 and D2. The though holes H1, H2, and H3 in FIG. 6 are defined by the protrusions H1', H2', and H3', and correspondingly, the contact portions 301 and 302 are defined by the recesses 301' and 302'. Referring to FIG. 7B, three openings S1, S2, and S3 are defined by contours of the though holes H1, H2 and H3 on the first surface 30'.

In FIG. 7A, the first and second molds D1 and D2 are connected from opposite sides of the openings S1, S2, and S3. In this embodiment, the first surface 30' and the openings S1, S2, and S3 are curved. When connecting the first and second molds D1 and D2, the protrusions H1', H2', and H3' of the first mold D1 move in a first direction A1 to the openings S1, S2, and S3, and correspondingly, the recesses 301' and 302' of the second mold D2 move in a second direction A2 to the openings S1, S2, and S3, opposite to the direction A1. Once the substrate module 300 is completely formed, the first and second molds D1 and D2 are separated.

Figure 8:
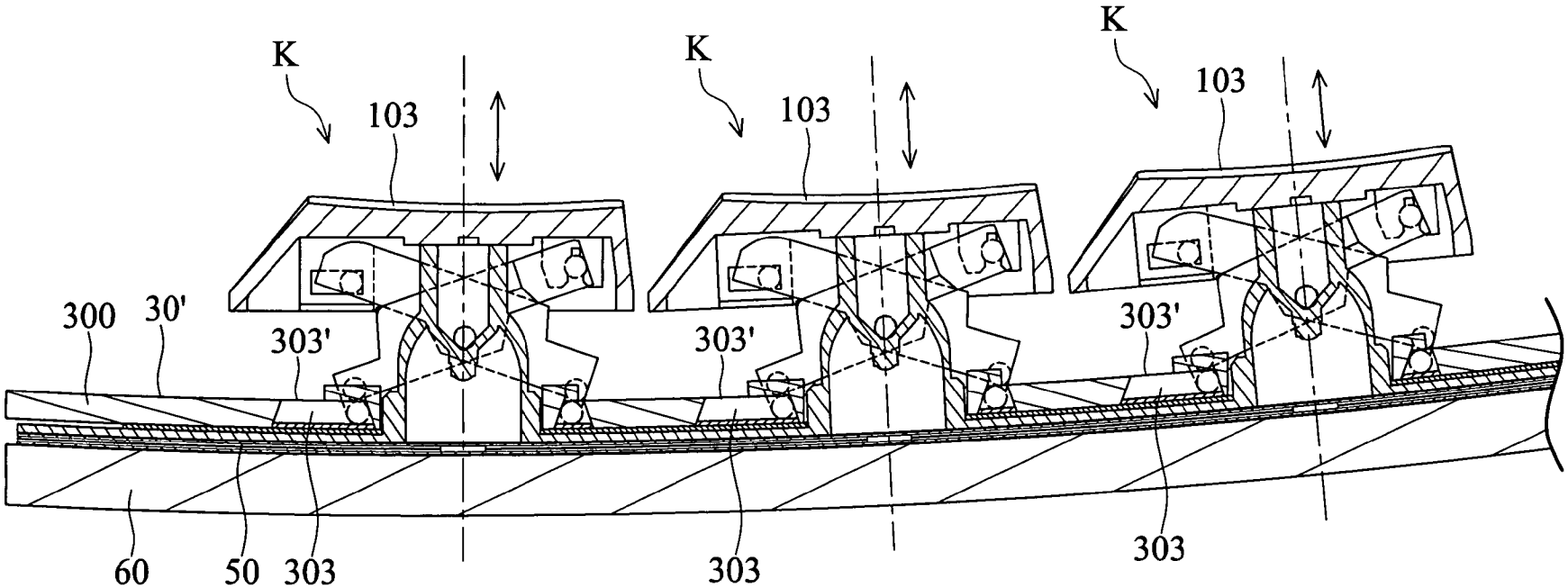
FIG. 8 is a sectional view of a plurality of key covers moving with respect to the substrate module.

Referring to FIG. 8, an embodiment of the substrate module 300 and the base plate 60 are curved, the profile of the base plate 60 corresponding to curvature of the first surface 30' and the openings 303'. In FIG. 8, the openings 303' of adjacent key structures K have a declination angle substantially equal to the declination angle between movement directions of adjacent key covers 103.

Keyboards and key structures thereof are provided according to the embodiments. The keyboard can be curved or wave-shaped with improved structural strength. Methods for manufacturing substrate modules and substrates of keyboards are also provided according to the embodiments, improving structural strength and reducing production cost.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation to encompass all such modifications and similar arrangements.

What is claimed is:

1. A key structure, comprising:

a substrate, comprising a first surface, a through hole and a plurality of contact portions fixed to the first surface, each of the contact portions having a contact surface partially covering the through hole, wherein the contact surface is substantially at the same level or lower than the first surface;

a first rod, comprising a first primary pivot accommodated in the through hole and slidable on one of the contact surfaces, and a first auxiliary pivot slidable on the first surface;

a second rod, movably connected to the first rod, comprising a second primary pivot accommodated in the through hole and a second auxiliary pivot abutting the first surface; and a key cover, movable with respect to the substrate and connected to the first and second rods.

2. The key structure as claimed in claim 1, wherein a contour of the through hole on the first surface defines an opening, and the contact surface is substantially at the same level or lower than the opening.

3. The key structure as claimed in claim 1, wherein the first and second auxiliary pivots are situated over the first surface, and the first and second primary pivots are situated below the first surface.

4. The key structure as claimed in claim 1, wherein the contact portions and the substrate are monolithically formed.

5. A key structure, comprising:

a substrate, comprising a first surface, a through hole and a plurality of contact portions fixed to the first surface, each of the contact portions having a contact surface partially covering the through hole, wherein the contact surface is substantially at the same level or lower than the first surface;

a first rod, comprising a first primary pivot;

a second rod, movably connected to the first rod, comprising a second primary pivot;

a key cover, movable with respect to the substrate and connected to the first and second rods; and a support member, contacting the first and second primary pivots, wherein at least one of the first and second primary pivots is slidable between the support member and one of the contact surfaces.

6. The key structure as claimed in claim 5, wherein a contour of the through hole on the first surface defines an opening, and the contact surface is substantially at the same level or lower than the opening.

7. The key structure as claimed in claim 5, wherein the contact portions and the substrate are monolithically formed.

8. The key structure as claimed in claim 5, wherein the support member has a laminar element abutting a bottom of the substrate.

9. The key structure as claimed in claim 5, wherein the support member is adhered to a bottom of the substrate.

10. The key structure as claimed in claim 5, wherein the support member comprises a sheet and a plurality of pads disposed thereon corresponding to the contact portions.

11. The key structure as claimed in claim 10, wherein the pads comprise elastic material.

12. The key structure as claimed in claim 10, wherein the sheet is adhered to a bottom of the substrate.

13. A keyboard having a plurality of key structures, each of the key structures comprising:

a substrate, comprising a curved surface, a through hole and a plurality of contact portions fixed to the first surface, each of the contact portions having a contact surface partially covering the through hole, wherein a contour of the through hole on the curved surface defines a curved opening, and the contact surface is substantially at the same level or lower than the curved opening;

a first rod, comprising a first primary pivot accommodated in the through hole;

a second rod, connecting the first rod and comprising a second primary pivot accommodated in the through hole, wherein the substrate and the first and second rods are rotatably connected via the first and second primary pivots; and a key cover, movable with respect to the substrate and connected to the first and second rods, wherein moving directions of the adjacent key covers form a declination angle, and the substrates of the key structures are integrally formed of plastic material in one piece as a substrate module.

14. The keyboard as claimed in claim 13, wherein an inner wall of the through hole is sloped with respect to a mold releasing direction of the substrate module.

15. The keyboard as claimed in claim 13, further comprising a top frame monolithically formed with the substrate module.

16. The keyboard as claimed in claim 13, further comprising a curved base plate and a circuit board disposed between the curved base plate and substrate module, wherein the profile of the curved pate corresponds to the curved surface.

17. The keyboard as claimed in claim 16, further comprising a bottom frame monolithically formed with the curved base plate.

18. A keyboard having a plurality of key structures, each of the key structures comprising:

a substrate, comprising a first surface, a through hole, and a plurality of contact portions fixed to the first surface, each of the contact portions having a contact surface partially covering the through hole, wherein a contour of the through hole on the first surface defines an opening, and the contact surface is substantially at the same level or lower than the opening;

a first rod, comprising a first primary pivot accommodated in the through hole;

a second rod, movably connecting the first rod and comprising a second primary pivot accommodated in the through hole, wherein the substrate and the first and second rods are rotatably connected via the first and second primary pivots; and a key cover, movable with respect to the substrate and connected to the first and second rods;

wherein the substrates of the key structures are monolithically formed of plastic material in one piece as a substrate module, and the adjacent openings form a declination angle therebetweeen substantially equal to an angle between two movement directions of the adjacent key covers.

19. The keyboard as claimed in claim 18, wherein an inner wall of the through hole is sloped with respect to a mold releasing direction of the substrate module.

20. The keyboard as claimed in claim 18, further comprising a top frame monolithically formed with the substrate module.

21. The keyboard as claimed in claim 18, further comprising a curved base plate and a circuit board disposed between the curved base plate and substrate module, wherein the profile of the curved base plate corresponds to the first surface.

22. The keyboard as claimed in claim 21, further comprising a bottom frame monolithically formed with the curved base plate.

* * * * *